US005666044A

United States Patent [19]

Tuozzolo

[11] Patent Number: 5,666,044

[45] Date of Patent: Sep. 9, 1997

[54] START UP CIRCUIT AND CURRENT-FOLDBACK PROTECTION FOR VOLTAGE REGULATORS

[75] Inventor: Claudio Tuozzolo, Cranston, R.I.

[73] Assignee: Cherry Semiconductor Corporation, East Greenwich, R.I.

[21] Appl. No.: 722,342

[22] Filed: Sep. 27, 1996

Related U.S. Application Data

[60] Provisional application No. 60/004,625 Sep. 29, 1995.

[51] Int. Cl.[6] ..... G05F 1/573; G05F 1/40

[52] U.S. Cl. ..... 323/277; 323/273; 323/901

[58] Field of Search ..... 323/901, 277, 323/275, 276, 280, 274, 284, 285

[56] References Cited

U.S. PATENT DOCUMENTS

| | | | |
|---|---|---|---|
| 3,753,078 | 8/1973 | Hedel | 323/9 |
| 3,988,643 | 10/1976 | Morris | 323/277 |
| 4,016,461 | 4/1977 | Roland | 323/901 |
| 5,592,072 | 1/1997 | Brown | 323/277 |

*Primary Examiner*—Peter S. Wong
*Assistant Examiner*—Bao Q. Vu
*Attorney, Agent, or Firm*—Bromberg & Sunstein LLP

[57] ABSTRACT

A circuit providing start-up capability and foldback protection to a voltage regulator. A start-up circuit provides a start-up signal to initiate current flow to a load and also provides a foldback signal to set a current limit threshold under an over-load or short-circuit condition. A signal generator circuit operating on the regulated output voltage of the voltage regulator provides a current limit signal and a start-up control signal. The start-up circuit provides the start-up signal in response to the start-up control signal. The current limit signal sets the current limit threshold under normal operating conditions after start-up.

24 Claims, 3 Drawing Sheets

START UP CIRCUIT AND CURRENT-FOLDBACK PROTECTION FOR VOLTAGE REGULATORS

This application claims the benefit of U.S. Provisional application Ser. No. 60/004,625, filed 29 Sep. 1995.

FIELD OF THE INVENTION

The present invention relates to a circuit that provides start-up capability and current-foldback protection, in addition to current-limit protection, and in particular such functions are provided for a voltage regulator.

BACKGROUND OF THE INVENTION

In order to improve the performance of voltage regulators whenever practical, the internal bias circuitry for the reference voltage and error or difference amplifier is directly derived from the regulated output voltage. As a result, these elements may not be self-starting when power is first applied to the regulator or when the output of the voltage regulator is shorted to ground. It is therefore required, in all these cases, to include start-up circuits to initiate and, if necessary, to maintain the flow of current independent of output conditions. Furthermore, most monolithic voltage regulators, in addition to current limit protection, also incorporate current foldback protection to prevent unnecessary power dissipation under short-circuit or current overload condition. This technique reduces the short-circuit current while still allowing full output current to be obtained during normal regulator operation.

Typically, current limit, current foldback protection, and start-up functions are distinct parts of the monolithic design and add to the complexity of the circuit.

In view of the foregoing, it is desirable to provide a current limiting circuit for a voltage regulator having the internal bias directly derived from the regulated output voltage, with current foldback protection provided directly using the start-up circuitry which initiates and maintains the flow of current independently of output condition.

SUMMARY OF THE INVENTION

It is a first aspect of the present invention to provide a start-up capability to a voltage regulator so that pass current in a pass transistor is started when the voltage regulator is first connected to a power supply.

It is another aspect of the present invention to provide current limiting so that pass current in the pass transistor is prevented from exceeding a current limit threshold.

It is yet another aspect of the present invention to provide current foldback protection so that the value of the current limit threshold is reduced when a short-circuit condition exists at the output terminal of the voltage regulator.

An embodiment of the present invention comprises a start-up circuit to provide a start-up signal to start pass current in the pass transistor, and a foldback signal, wherein the start-up signal and the foldback signal are responsive to a start-up control signal; an output stage circuit, having an input terminal with an input voltage, responsive to the start-up signal, to control the pass current in response to the input voltage when the pass transistor is coupled to the output stage circuit; a signal generator circuit, coupled to the output voltage terminal, to provide a current limit signal and the start-up control signal, wherein the current limit signal and the start-up control signal are responsive to the output voltage; a signal combiner circuit connected to receive the foldback signal and the current limit signal so as to provide a limit signal responsive to the foldback signal and the current limit signal; and a current limit amplifier responsive to a current sense signal and the limit signal, and coupled to the input terminal of the output stage to limit the pass current from exceeding a current limit threshold, where the current sense signal is indicative of the pass current.

In a further embodiment of the present invention, the signal generator circuit comprises a voltage reference circuit, responsive to the output voltage, to provide a first reference voltage; a voltage controlled current sink, responsive to the first reference voltage and the output voltage, to provide a reference current; a first current mirror to provide the start-up control signal, where the start-up control signal is a start-up control current responsive to the reference current, and to provide a first mirror current responsive to the reference current; and a second current mirror, responsive to the reference current, to provide the current limit signal, where the current limit signal is a limit current responsive to the first mirror current. The voltage reference circuit provides a second reference voltage, responsive to the output voltage, to a difference amplifier and the first current mirror provides a bias current to the difference amplifier responsive to the reference current, wherein the difference amplifier is responsive to the second reference voltage, the output voltage, and the bias current, the difference amplifier having an output terminal with a control voltage, wherein the control voltage is responsive to the difference between the second reference voltage and a difference input voltage, wherein the difference input voltage is a function of the output voltage, the difference amplifier including a matched pair of transistors having emitters where current flow in the emitters is regulated by the bias current, the output terminal of the difference amplifier coupled to the input terminal of the output stage circuit to regulate the output voltage at the output voltage terminal. The start-up circuit comprises a current source to provide a source current to a third current mirror, where the third current mirror provides the foldback signal in the form of a foldback current and also provides a second mirror current to a fourth current mirror, where the fourth current mirror is responsive to the second mirror current and provides the start-up signal in the form of a start-up current so as to start pass current in the pass transistor when the voltage regulator is first connected to a power supply.

DETAILED DESCRIPTION OF THE PREFERRED EMBODIMENTS

Figure 1:
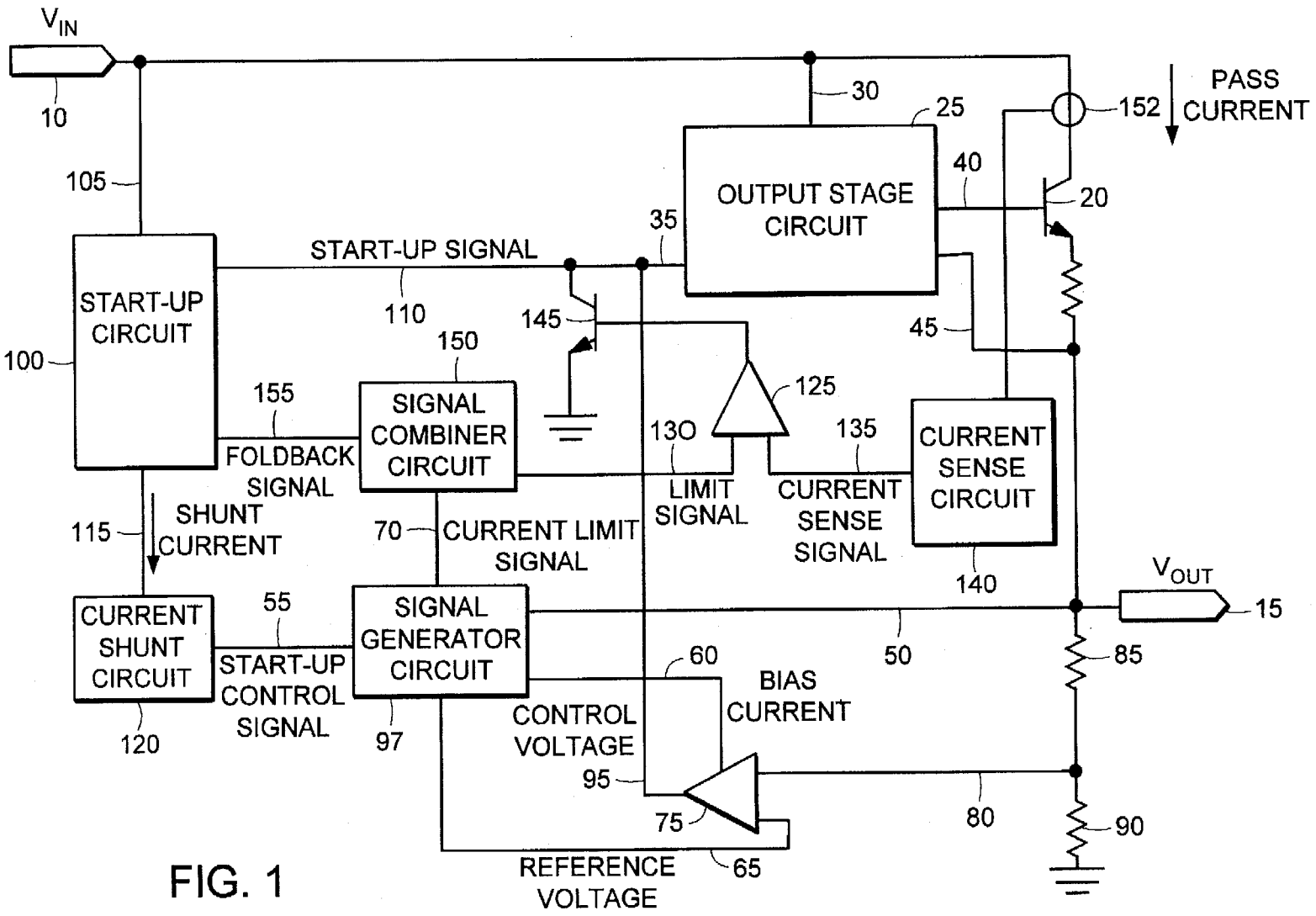
FIG. 1 is a block diagram of an embodiment of the present invention.

FIG. 1 shows a block diagram of an embodiment of the present invention. Input terminal 10 is connected to a power supply (not shown) supplying an input voltage $V_{IN}$. Output terminal 15 provides a regulated output voltage, $V_{OUT}$, to a load (not shown) connected to output terminal 15. Pass transistor 20 has a pass current flowing from its collector to its emitter. Output stage circuit 25 is connected to input terminal 10 via line 30, and has an input terminal 35 and output terminals 40 and 45. The voltage difference between output terminals 40 and 45 depends upon an input applied to input terminal 35. The amount of pass current flowing through pass transistor 20 is directly controlled by the voltage difference between output terminals 40 and 45, which is in turn controlled by an input applied to input terminal 35. The pass current is controlled so that the output voltage $V_{OUT}$ is regulated for varying loads.

The essential function of output stage circuit 25 is to provide current gain so that pass transistor 20 can be controlled without loading down input terminal 35. Any circuit achieving this function may be used as an output stage circuit.

Signal generator circuit 47 is connected to output terminal 15 via line 50. Signal generator circuit 47 provides a start-up control signal on line 55, a bias current on line 60, a reference voltage on line 65, and a current limit signal on line 70. The functions of the start-up control signal, the bias current, the reference voltage, and the current limit signal will be explained in the course of describing the other components of FIG. 1. An important feature shared by the start-up control signal, current limit signal, reference voltage, and bias current is that they are regulated directly by the output voltage $V_{OUT}$.

Difference amplifier 75 has an input connected to line 65 to receive the reference voltage and an input connected to line 80, where line 80 has a voltage proportional to $V_{OUT}$ because of the voltage divider defined by resistors 85 and 90. Difference amplifier 75 outputs a control voltage on line 95, which is connected to input terminal 35 of output stage circuit 25. Difference amplifier 75 amplifies the difference between the voltages at its inputs, and receives a bias current on line 60. The bias current is supplied by signal generator circuit 47.

The output voltage $V_{OUT}$ is regulated by difference amplifier 75 adjusting the control voltage so as to keep the voltage on line 80 essentially equal to the reference voltage on line 65. Because the bias current and reference voltage applied to difference amplifier 75 are provided by signal generator circuit 47, and because signal generator circuit 47 derives its power directly from terminal 15 and ground, where the output voltage $V_{OUT}$ of terminal 15 is regulated, the bias current and reference voltage are better regulated than in a conventional circuit in which the bias current and reference voltage are directly derived from the unregulated input terminal 10. That is, feedback from terminal 15 to difference amplifier 75 via signal generator circuit 47 further enhances regulation.

However, because signal generator circuit 47 depends directly upon $V_{OUT}$, it will begin to shut down when $V_{OUT}$ drops below some lower limit. The lower limit is that value of output voltage $V_{OUT}$ at which signal generator circuit 47 begins to run out of "headroom", in which case the bias current and the reference voltage begin to decrease. Start-up circuit 100 is therefore necessary to start pass current flowing in pass transistor 20 until $V_{OUT}$ increases above the lower limit.

Start-up circuit 100 is connected to input terminal 10 via line 105 and supplies a start-up signal on line 110. Current shunt circuit 120 shunts current on line 115 from start-up circuit 100 in response to the start-up control signal on line 55. The start-up signal is at a maximum when no current is being shunted from start-up circuit 100, and decreases as current is shunted.

When $V_{OUT}$ is below the lower limit, which will be the case immediately after input terminal 10 is connected to a power supply, start-up circuit 100 is active and supplies a start-up signal on line 110 sufficient to cause output stage circuit 25 to turn pass transistor 20 ON. This will cause $V_{OUT}$ to rise above the lower limit, which will cause signal generator circuit 47 to provide a start-up control signal to current shunt circuit 120. This start-up control signal will cause current shunt circuit 120 to shunt current from the start-up circuit, which causes the start-up signal to diminish. When the shunt current is sufficiently large, start-up circuit 100 is not active in the sense that the start-up signal is absent. The output voltage $V_{OUT}$ is then properly regulated by the action of difference amplifier 75, as discussed earlier.

It is also desirable to prevent the pass current from exceeding a current limit threshold. This is accomplished by current sense amplifier 125. Current sense amplifier 125 has an input connected to line 130 to receive a limit signal and another input connected to line 135 to receive a current sense signal. The current sense signal is indicative of the pass current, and is generated by current sense circuit 140. The limit signal sets the current limit threshold. The output of current sense amplifier 125 is connected to transistor 145. Depending upon the relationship between the limit signal and the current sense signal, the output of current sense amplifier 125 will go high, bringing transistor 145 into conduction and shunting current from input 35 of output stage circuit 25, which in turn causes a decrease in the pass current.

In a preferred embodiment, the voltages of the current sense and limit signals are the quantities of interest, where the voltage of the current sense signal decreases as the pass current increases. In this case, the output of current sense amplifier 125 will go high when the voltage of the current sense signal is less than the voltage of the limit signal, and therefore the current limit threshold is that value of the pass current for which the voltages of the limit signal and the current sense signal are equal. It should be clear to one of ordinary skill that similar circuits for limiting the pass current can be constructed in which the voltage of the current sense signal increases with pass current, or that the current of the current sense and limit signals, rather than their voltages, are the quantities of interest. Current sense amplifier 125 may be a conventional amplifier, such as a compensated op-amp.

The limit signal is provided by signal combiner circuit 150, which in turn is responsive to the current limit signal on line 70 and a foldback signal on line 155. Under normal operating conditions when the start-up circuit is not active, the foldback signal is not present and the limit signal is responsive only to the current limit signal. Because signal generator circuit 47 operates directly from output terminal 15, it will begin to shut down when the output voltage $V_{OUT}$ drops below the lower limit, as discussed previously. As $V_{OUT}$ drops below the lower limit, it is desirable that the current limit threshold decrease, so as to prevent destruction of pass transistor 20. Thus, for the preferred embodiment in which the voltage of the current sense signal decreases as the pass current increases, it is desirable that the voltage of the limit signal increases as $V_{OUT}$ decreases so that the current limit threshold decreases.

As output voltage $V_{OUT}$ approaches the lower limit, the current limit signal will decrease and signal combiner circuit 150 will cause the voltage of the limit signal to increase. However, if the foldback signal was not present, the voltage of the limit signal would increase to its maximum value, which is the input voltage $V_{IN}$. If this were to happen, the current limit threshold would be set to zero, and it may be difficult to start-up the voltage regulator because current sense amplifier 125 would always be trying to shunt current from input 35. Advantageously, a foldback signal is provided by start-up circuit 100 so as not to set the current limit threshold to zero when $V_{OUT}$ falls below the lower limit. With the foldback signal present when start-up circuit 100 is activated, signal combiner circuit 150 provides a limit signal even though the current limit signal may not be present.

In another embodiment of the invention, it may be possible that current sense circuit 140 is such that the voltage of the current sense signal increases when the pass current increases, in which case the signal combiner circuit 150 would be constructed such that the voltage of the limit signal would decrease as signal generator circuit 47 runs out of headroom. However, a foldback signal would still be advantageous to prevent the limit signal from decreasing to its minimum value, so that the current limit threshold is not set too low.

Figure 2:
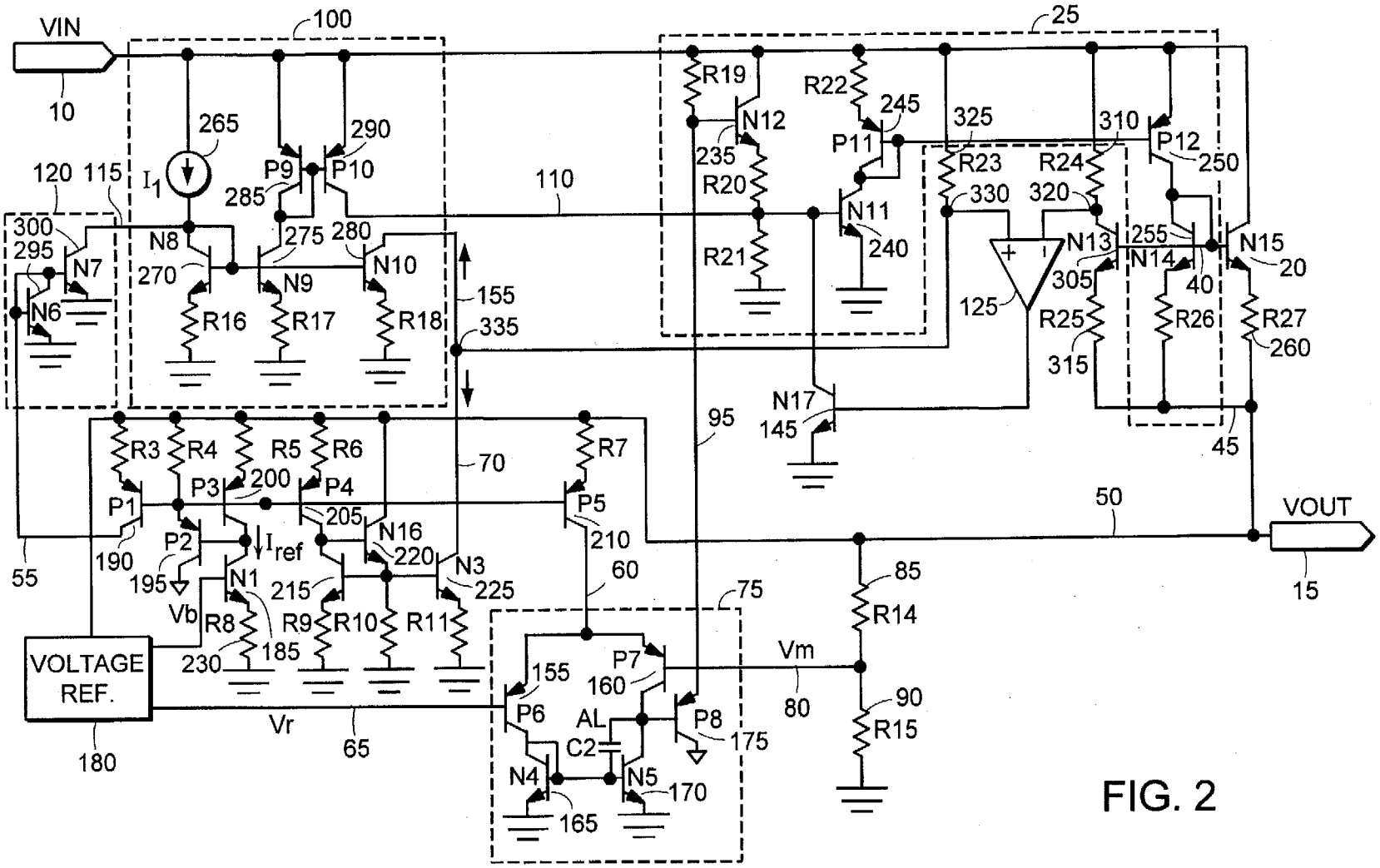
FIG. 2 is a circuit schematic of an embodiment of the present invention.

Current sense circuit 140 may be coupled to pass transistor 20 in various ways, which is discussed in reference to FIG. 2. Circle 152 indicates that this coupling may be performed in many ways without departing from the spirit or scope of the present invention.

FIG. 2 is a more detailed schematic of the presently preferred embodiment. Some components in FIG. 2 with a corresponding component in FIG. 1 are labeled with the same numerals. When an input voltage is applied to input terminal 10 and a load is connected to output terminal 15, a pass current is conducted between input terminal 10 and output terminal 15 by pass transistor 20 in response to a control signal on line 95 generated by difference amplifier 75. Difference amplifier 75 compares the reference voltage, $V_{ref}$, on line 65 with the sampled and scaled output voltage, $V_S$, on line 80 to generate the control signal so as to regulate the voltage drop across pass transistor 20 such that the condition $V_{ref}=V_S$ is fulfilled. Matched transistors 155 and 160 form the so-called long-tailed pair of difference amplifier 75. Matched transistors 165 and 170 form a current mirror serving as the active load for transistors 155 and 160. Transistor 175 serves as an emitter follower 175.

Signal generator circuit 47 may be identified with voltage reference circuit 180, transistor 185, transistors 190, 195, 200, 205, and 210, which serve as a current mirror, and transistors 215, 220, and 225, which serve as another current mirror. Reference voltage circuit 180 can be, for example, any well-known bandgap voltage reference circuit.

Reference voltage circuit 180 also provides a second voltage reference, $V_b$, at the base of transistor 185. Transistor 185 serves as a voltage-controlled current sink, sinking a bias or reference current $I_{ref}$ at its collector. In the preferred embodiment, the voltage $V_b$ is a temperature-independent voltage and the reference current $I_{ref}$ has a low temperature coefficient. The negative temperature variation, −2mV/°C., of the base-emitter voltage, $V_{BE}$ is of transistor 185 is canceled by properly choosing the value of resistor 230, which has a positive temperature coefficient. The voltage $V_b$ applied at the base of transistor 185 is chosen to satisfy the condition $V_b=V_{BE}+RI_{ref}$, where R the resistance of resistor 230.

The reference current is mirrored by the current mirror comprising transistors 190, 195, 200, 205, and 210. The collector of transistor 210 provides the bias current to the matched transistor pair 155 and 160 of difference amplifier 75. The collector of transistor 190 provides the start-up control signal on line 55, in which case the start-up control signal may be considered a start-up control current because the quantity of interest is a current. The collector of transistor 205 provides a second reference current to the current mirror comprising transistors 215, 220, and 225. The collector of transistor 225 provides the current limit signal on line 70, which may be considered a limit current because the quantity of interest is a current.

The reference voltage $V_{ref}$ and the bias current for difference amplifier 75 is directly derived from the regulated output voltage via line 50 to improve the performance of the regulator. In this sense, the reference voltage and the bias current, as well as the start-up control current and limit current, are regulated by the output voltage at output terminal 15. The relative values of the start-up control current, the bias current, and the limit current relative to the reference current are determined by the emitter areas and emitter resistors associated with transistors 185, 190, 200, 205, 210, 215, and 225.

Transistors 195 and 220 serve as buffers to supply base currents to their respective current mirrors. The arrow at the collector of transistor 195 indicates that it is a vertical pnp transistor in which its collector is connected to the substrate, or ground. Transistor 175 is also a vertical pnp transistor with its collector connected to ground.

Transistors 235, 240, 245, 250, and 255 form the output stage circuit of the regulator. Difference amplifier 75 drives the base of transistor 235 in such a manner that when the output voltage rises above the desired regulated value, the voltage at this node decreases, in turn causing a decrease in current conducted by transistors 235, 240, 245, 250, 255, and pass transistor 20.

Pass transistor 20 is conventionally structured comprising individual base regions with a number of individually ballasted emitter stripes. Resistor 260 represents the ballast resistors for the individual emitter stripes of transistor 20. Diode-connected transistor 255, together with transistor 20, forms a controlled-gain section where the effective current gain is equal to the emitter area ratio of transistor 20 to transistor 255.

Start-up circuit 100 comprises current source 265, which sources a source current, a current mirror comprising transistors 270, 275, and 280, and a current mirror comprising transistors 285 and 290. Current shunt circuit 120 is connected to current source 265. Assume that current shunt circuit 120 is not shunting current. Then, when the power supply voltage is first applied to input terminal 10, transistor 275 sinks a current from the current mirror comprising transistors 285 and 290, which in turn provides the start-up signal on line 110, which is a start-up current, to the base of transistor 240, whose conduction causes the output stage circuit to turn ON and pass transistor 20 to conduct. Transistor 280 also sinks a current at its collector, which is the foldback signal. Thus, the foldback signal on line 155 is a foldback current due to the current mirror comprising transistors 270 and 280.

As previously stated, the reference current $I_{ref}$ is responsive to the output voltage and the addition of start-up circuit 100 ensures the flow of pass current independently of output condition when the power is first applied to the voltage regulator. Start-up circuit 100 must not interfere with the normal operation of the regulator once the circuit has reached the desired regulation point. It is therefore required that, as the output of the regulator approaches the desired regulation point, start-up circuit 100 is turned OFF by the start-up control signal, which is responsive to reference current $I_{ref}$.

As the start-up current begins to increase, the voltage at output terminal 15 starts to increase from ground potential and when it is greater than two base-emitter voltage drops, which is necessary to turn ON transistors 195 and 200 and to develop a forward biasing voltage at the base of transistor 230, transistor 230 starts to conduct and initiates current flow for $I_{ref}$. From this point on, the reference current $I_{ref}$ gradually increases before reaching the desired operating value, providing the bias current for the difference amplifier 75 which in turn drives the voltage regulator into regulation. As $I_{ref}$ increases toward the desired value, transistor 190 provides the start-up control current to current shunt circuit 120.

Current shunt circuit 120 comprises transistors 295 and 300 configured as a current mirror. In response to the start-up control current on line 55, the collector of transistor 300 sinks current, thereby shunting some or all of the source current provided by current source 265. It would be clear to one of ordinary skill that current shunt circuit 120 may be realized by other circuit configurations than the one illustrated in FIG. 2. For example, a field-effect transistor (FET) may be used to shunt current from current source 265 to ground (the substrate). In this case, line 55 would be coupled to the gate of the FET, and the gate would be coupled to ground via a resistor. The FET's drain (or source) would be connected to current source 265 to shunt current. Consequently, current shunt circuit 120 maybe any circuit which shunts current from current source 265 in response to the start-up control signal on line 55 without departing from the scope or spirit of the present invention.

When current shunt circuit 120 shunts all the source current provided by current source 265, transistor 270 is OFF, which consequently keeps transistor 290 OFF, and output stage circuit 25 is driven only by the control signal generated by difference amplifier 75. Transistor 280 is also OFF, and consequently there is no foldback current on line 155. Thus, start-up circuit 100 is de-activated, or turned OFF, by the shunting action of current shunt circuit 120, which in turn is activated by the start-up control current on line 55. Therefore, when signal generator circuit 47 reaches its normal operating point, start-up circuit 100 is not providing the start-up and foldback currents.

Transistor 145 and current limit amplifier 125 comprise a current limit circuit. Transistor 305, which has emitter area n times smaller than transistor 20, acts as a current sensing transistor such that its collector current is a fraction of the current conducted by pass transistor 20, providing a direct measure of the output current. It would be clear to one of ordinary skill that other methods may be employed to sense the pass current. For example, a current sense resistor can be connected to the collector of transistor 20 in which the voltage drop across the current sense resistor is proportional to the pass current.

Transistor 305 and resistors 310 and 315 serve the function of current sense circuit 140. The value of resistor 315 is n times that of resistor 260 and, as a result, the total current conducted by transistor 305 is n times smaller than the current conducted by pass transistor 20. The current conducted by sensing transistor 305 is not part of the ground current and does not contribute to stand-by current, being directly available for the output load. The current conducted by transistor 305 is sensed by resistor 3 10 and a voltage drop is developed across this resistor which is substantially proportional to the output current of the regulator circuit. As long as the voltage developed across resistor 310 plus the collector-emitter saturation voltage of transistor 305 is less than the total of the base-emitter voltage of transistor 20 and the collector-emitter saturation voltage of transistor 250, it will not increase the dropout voltage of the regulator. The current sense signal is developed at node 320 and the quantity of interest is its voltage, where the voltage of the current sense signal increases when the pass current decreases.

Current limit amplifier 125 drives transistor 145 into conduction whenever the voltage drop across resistor 320 reaches a threshold value established by the voltage developed across resistor 325. Specifically, when the voltage developed at node 330 is greater than the voltage developed at node 320, current sense amplifier 125 causes transistor 145 to shunt drive current away from the base of transistor 240 therefore limiting the current conducted by pass transistor 20 to maintain the balance in the input voltages at the current limit amplifier.

Signal combiner circuit 150 consists simply of the connection of lines 155 and 70 at node 335, and the connection of resistor 325 to node 335, as seen in FIG. 2. The limit signal is thus seen to be a limit voltage developed at node 330. The limit voltage is a function of the sum of the foldback current and the limit current, and increases as this sum decreases. Because of the low temperature coefficient of the reference current $I_{ref}$, the limit voltage developed at node 330 for the current limit amplifier is approximately temperature insensitive, and temperature changes minimally add to variations in the current limit threshold.

The overall change of the current limit threshold is only a mere 6% across the full temperature range that extends from −40° C. to 150° C., with the current limit threshold being actually lower at the two temperature extremes −40° C. and 150° C.

As discussed previously, current mirror transistor 280 provides the foldback current, which causes the current limit circuit of current sense amplifier 125 and transistor 145 to limit the pass current of the voltage regulator to lower current limit threshold values when a short-circuit condition is approached at output terminal 15. This prevents unnecessary power dissipation under short-circuit or current overload conditions During current limiting, the limiting of pass current causes a drop in the voltage at output terminal 15, which in turn causes a progressive reduction in the limit current on line 70. The progressive decrease of this current is due to a combination of two factors. First, because the limit current is directly derived from the regulated output voltage at output terminal 15, lower values for the output voltage $V_{OUT}$ correspond to lower values for the limit current. Second, as the regulated output voltage decreases below a lower limit, the voltage reference circuit 180, which also derives its bias voltage directly from the output terminal 15, starts to run out of "headroom" resulting in a consequent decrease in the second reference voltage applied at the base of transistor 230, which in turn causes a drop in $I_{ref}$ and therefore in the limit current on line 70. The point at which voltage reference circuit 180 starts to run out "headroom" depends on the type of voltage reference circuit being used, and consequently the lower limit is equal to either two base-emitter voltage drops, $2V_{BE}$, or that output voltage at which voltage reference circuit 180 runs out of headroom, which ever is greater. In a preferred embodiment the voltage reference circuit 180 runs out of headroom when the regulated output voltage drops below 2.5 V.

In view of the foregoing, the voltage drop developed across resistor 325 decreases as the output voltage drops below the regulation level and hence, the current limit threshold value decreases. Simultaneously, current mirror transistor 190, which was causing current mirror transistors 295 and 300 to shunt current source 265 to ground, now conducts a decreasing amount of current which allows current mirror transistors 270, 275, and 280 to gradually turn ON.

As the output voltage drops below two base-emitter voltage drops, the reference current $I_{ref}$ is turned completely off and so is the limit current on line 70. Current mirror transistors 270, 275, and 280, on the other hand, are fully turned ON, and the current limit threshold reaches a lower limit exceeding zero, determined by the voltage drop developed across resistor 325 by the foldback current provided by transistor 280.

Figure 3:
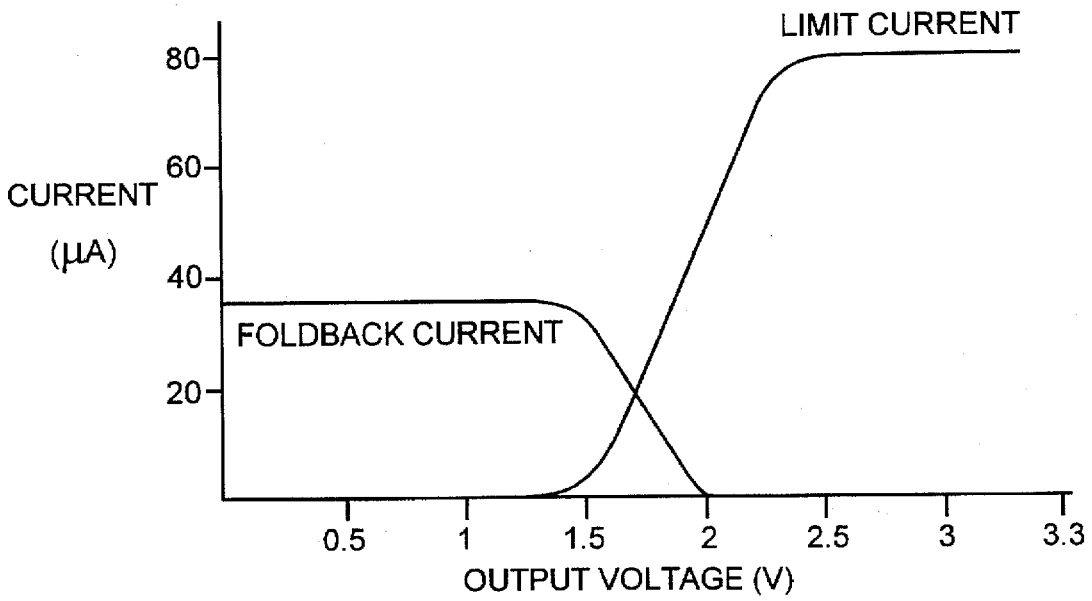
FIG. 3 is a plot showing the relationship between the foldback current and the limit current as a function of the output voltage for an embodiment of the present invention.

FIG. 3 illustrates the behavior of the limit current and the foldback current versus the output voltage at output terminal 15. Preferably, values for the limit current and the foldback current are chosen to define the short-circuit current to be no greater than one half of the maximum output current. However, other values may be used if desired. Furthermore, in the preferred embodiment, the source current provided by current source 265 has a low temperature coefficient, being substantially the same as the temperature coefficient of reference current $I_{ref}$. Thus, because the source current sets the current-foldback point through transistor 280 and resistor 325, a low temperature coefficient in the source current of current source 265 directly yields a small change in the short-circuit current limit threshold due to temperature variations.

Figure 4:
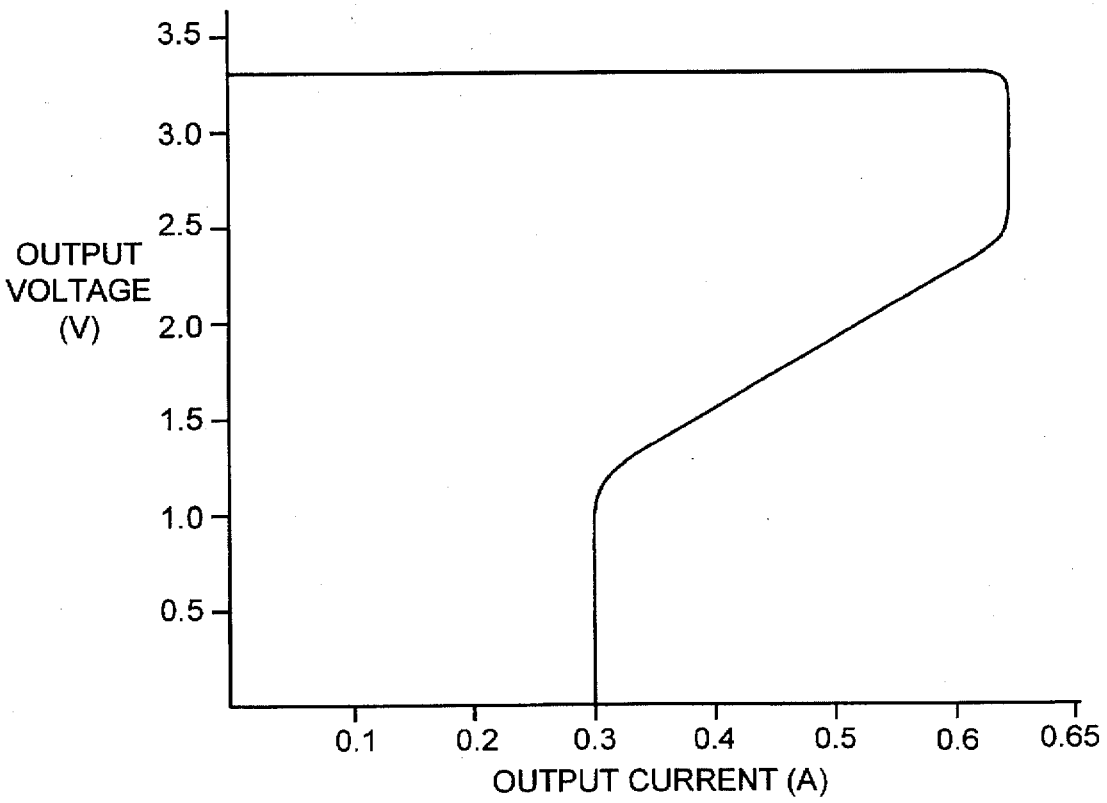
FIG. 4 is a plot of output voltage vs. output current to illustrate the foldback protection provided by an embodiment of the present invention.

FIG. 4 illustrates how the current limit function of the embodiment in FIG. 2 affects the operation of the voltage regulator as a short-circuit condition is approached at outputs terminal 15. In this particular case, the nominal regulated output voltage is 3.3V, the maximum current limit threshold (when the foldback current is zero and $I_{ref}$ is at its maximum) is chosen to be 650 mA, and the minimum or short-circuit current limit threshold (when $I_{ref}$ is zero and the foldback current is at its maximum) is chosen to be 300 mA. Again, other values may be used if desired.

As shown in FIG. 4, the current limit function of the voltage regulator of FIG. 2 causes the current limit threshold to decrease as the output voltage at output terminal 15 drops below 2.4 V, due to an overload condition present at output terminal 15. This first breakpoint corresponds to the progressive decrease of the limit current on line 70 due to the drop in the output voltage. As the output voltage decreases even further and drops below 1.3 V, a second breakpoint is introduced in the curve. At this particular point, the limit current is equal to zero, the start-up current is completely turned on, and a minimum current limit threshold value is established by the foldback current and resistor 325. The short-circuit current limit threshold is less than the current limit threshold at the first breakpoint, and unnecessary power dissipation is prevented.

It is to be understood that numerous modifications may be made to the specific embodiments which have been described without departing from the spirit or scope of the invention. For example, the quantity of interest in the current limit signal may be a voltage, rather than a current as in the embodiment of FIG. 2, where this voltage may be provided directly from voltage reference circuit 180. The quantity of interest in the foldback signal may also be a voltage. For the case in which the quantities of interest for both the current limit signal and foldback signal are their respective voltages, signal combiner circuit 150 would be a voltage summing amplifier. Similarly, the start-up control signal provided by signal generator circuit 47 could be a voltage, in which case current shunt circuit 120 could be a FET with its gate responsive to the voltage of the start-up control signal.

What is claimed is:

1. A circuit, connectable to a pass transistor for starting-up and limiting pass current in the pass transistor, having an output terminal with an output voltage, the circuit comprising:

a start-up circuit to provide a start-up signal and a foldback signal, wherein the start-up signal and the foldback signal are responsive to a start-up control signal;

an output stage circuit, having an input terminal with an input voltage, responsive to the start-up signal, to control the pass current in response to the input voltage when the pass transistor is coupled to the output stage circuit;

a signal generator circuit, coupled to the output voltage terminal, to provide a current limit signal and the start-up control signal, wherein the current limit signal and the start-up control signal are responsive to the output voltage; and a current limit amplifier responsive to a current sense signal and a limit signal, and coupled to the input terminal of the output stage to limit the pass current from exceeding a current limit threshold, where the current sense signal is indicative of the pass current and the limit signal is responsive to the foldback signal and the current limit signal.

2. The circuit as set forth in claim 1, further comprising a signal combiner circuit connected to receive the foldback signal and the current limit signal to provide the limit signal.

3. The circuit as set forth in claim 2, wherein the signal generator circuit comprises:

a voltage reference circuit, responsive to the output voltage, to provide a first reference voltage;

a voltage controlled current sink, responsive to the first reference voltage and the output voltage, to provide a reference current;

a first current mirror to provide the start-up control signal, where the start-up control signal is a start-up control current responsive to the reference current, and to provide a first mirror current responsive to the reference current; and a second current mirror, responsive to the reference current, to provide the current limit signal, where the current limit signal is a limit current responsive to the first mirror current.

4. The circuit as set forth in claim 3, wherein the voltage reference circuit provides a second reference voltage responsive to the output voltage and the first current mirror provides a bias current responsive to the reference current, the circuit further comprising a difference amplifier, the difference amplifier being responsive to the second reference voltage, the output voltage, and the bias current, the difference amplifier having an output terminal with a control voltage, wherein the control voltage is responsive to the difference between the second reference voltage and a difference input voltage, wherein the difference input voltage is a function of the output voltage, the difference amplifier including a matched pair of transistors having emitters where current flow in the emitters is regulated by the bias current, the output terminal of the difference amplifier coupled to the input terminal of the output stage circuit to regulate the output voltage at the output voltage terminal.

5. The circuit as set forth in claim 2, wherein the start-up circuit comprises:

a current source to provide a source current;

a first current mirror, responsive to the start-up control signal and the source current, to provide the foldback signal, wherein the foldback signal is a foldback current, and to provide a first mirror current; and a second current mirror, responsive to the first mirror current, to provide the start-up signal, wherein the start-up signal is a start-up current responsive to the first mirror current.

6. The circuit as set forth in claim 5, further comprising a current shunt circuit, responsive to the start-up control signal, to shunt a shunt current from the current source, so that the start-up current and the foldback current decrease as the shunt current increases.

7. The circuit as set forth in claim 6, wherein the signal generator circuit comprises:

a voltage reference circuit, responsive to the output voltage, to provide a first reference voltage;

a voltage controlled current sink, responsive to the first reference voltage and the output voltage, to provide a reference current;

a third current mirror to provide the start-up control signal, where the start-up control signal is a start-up control current responsive to the reference current, and to provide a second mirror current responsive to the reference current; and a fourth current mirror, responsive to the reference current, to provide the current limit signal, where the current limit signal is a limit current responsive to the second mirror current.

8. The circuit as set forth in claim 7, wherein the voltage reference circuit provides a second reference voltage responsive to the output voltage and the third current mirror provides a bias current responsive to the reference current, the circuit further comprising a difference amplifier, the difference amplifier being responsive to the second reference voltage, the output voltage, and the bias current, the difference amplifier having an output terminal with a control voltage, wherein the control voltage is responsive to the difference between the second reference voltage and a difference input voltage, wherein the difference input voltage is a function of the output voltage, the difference amplifier including a matched pair of transistors having emitters where current flow in the emitters is regulated by the bias current, the output terminal of the difference amplifier coupled to the input terminal of the output stage circuit to regulate the output voltage at the output voltage terminal.

9. The circuit as set forth in claim 8, wherein the signal combiner circuit comprises a first resistor with a terminal coupled to the first current mirror and to the fourth current mirror, so that current flowing in the first resistor is the sum of the foldback current and the limit current, wherein the limit signal is a limit voltage developed at the terminal of the first resistor.

10. The circuit as set forth in claim 7, further comprising a current sense circuit, the current sense circuit including a first transistor to sink a sense current substantially proportional to the pass current, a second resistor having a terminal coupled to the first transistor so that current flowing in the second resistor is substantially equal to the sense current, wherein the current sense signal is a sense voltage developed at the terminal of the second resistor; and wherein the current limit threshold is a value of the pass current for which the limit voltage is substantially equal to the sense voltage.

11. A voltage regulator, having an output terminal with an output voltage, for regulating the output voltage, the voltage regulator comprising:

a pass transistor to provide a pass current to a load;

a start-up circuit to provide a start-up signal to start the pass current in the pass transistor when the output voltage is less than a lower limit, and to provide a foldback signal, wherein the start-up signal and the foldback signal are responsive to a start-up control signal;

an output stage circuit, having an input terminal with an input voltage, responsive to the start-up signal, coupled to the pass transistor to control in response to the input voltage the pass current;

a signal generator circuit, responsive to the output voltage terminal, to provide a current limit signal, a first reference voltage, and the start-up control signal;

a signal combiner circuit connected to receive the foldback signal and the current limit signal so as to provide a limit signal responsive to the foldback signal and the current limit signal;

a difference amplifier, the difference amplifier being responsive to the first reference voltage and the output voltage, the difference amplifier having an output terminal coupled to the input terminal of the output stage circuit, wherein a control voltage at the output terminal of the difference amplifier is responsive to the difference between the first reference voltage and a difference input voltage, wherein the difference input voltage is a function of the output voltage;

a current sense circuit, responsive to the pass current, to provide to the current limit amplifier a current sense signal indicative of the pass current; and a current limit amplifier responsive to the current sense signal and the limit signal, and coupled to the input terminal of the output stage to limit the pass current from exceeding a current limit threshold, where the current sense signal is indicative of the pass current.

12. The voltage regulator as set forth in claim 11, wherein the signal generator circuit provides a bias current; and the difference amplifier further comprises a matched pair of transistors having emitters where current flow in the emitters is regulated by the bias current.

13. The voltage regulator as set forth in claim 12, wherein the signal generator circuit comprises:

a voltage reference circuit to provide the first reference voltage and a second reference voltage;

a voltage controlled current sink, responsive to the second reference voltage, to sink a reference current; and a first current mirror to provide the start-up control signal, the bias current, and a first mirror current, where the start-up control signal is a start-up control current, where the bias current, the first mirror current, and the start-up control current are responsive to the reference current and the output voltage, the first current mirror including a plurality of transistors, each transistor in the plurality of transistors with an emitter, and a plurality of resistors equal in number to the plurality of transistors, each resistor in the plurality of resistors having first and second terminals, each emitter in the plurality of transistors coupled to the first terminal of a corresponding resistor in the plurality of resistors, wherein all the second terminals of the plurality of resistors are at a voltage directly dependent upon the output voltage.

14. The voltage regulator as set forth in claim 13, wherein the signal generator circuit further comprises a second current mirror to provide the current limit signal, where the current limit signal is a limit current responsive to the first mirror current.

15. The voltage regulator as set forth in claim 14, wherein the start-up circuit comprises:

a current source to provide a source current;

a third current mirror to provide the foldback signal and a second mirror current, where the foldback signal is a foldback current, where the foldback current and the second mirror current are responsive to the source current and the start-up control current; and a fourth current mirror to provide the start-up signal, where the start-up signal is a start-up current responsive to the second mirror current.

16. The voltage regulator as set forth in claim 15, further comprising a current shunt circuit, responsive to the start-up control current, to shunt a shunt current from the current source, so that the start-up current and the foldback current decrease as the shunt current increases.

17. The voltage regulator as set forth in claim 16, wherein the signal combiner circuit comprises a first resistor with a terminal coupled to the second current mirror and to the third current mirror, so that current flowing in the first resistor is the sum of the foldback current and the limit current, wherein the limit signal is a limit voltage developed at the terminal of the first resistor.

18. The voltage regulator as set forth in claim 17, wherein the current sense circuit comprises a first transistor to sink a sense current substantially proportional to the pass current, a second resistor having a terminal coupled to the first transistor so that current flowing in the second resistor is equal to the sense current, wherein the current sense signal is a sense voltage developed at the terminal of the second resistor; and wherein the current limit threshold is a value of the pass current for which the limit voltage is substantially equal to the sense voltage.

19. An integrated circuit with a substrate and an output voltage terminal for regulating an output voltage between the output voltage terminal and the substrate, and for starting-up and limiting pass current in a pass transistor having a base, a collector, and an emitter, the integrated circuit comprising:

an input voltage terminal having an input voltage with respect to the substrate;

a current source, having a first terminal coupled to the input voltage terminal and having a second terminal, for providing at the second terminal a source current responsive to the input voltage and for providing on a first line coupled to the second terminal a start-up signal responsive to the source current and responsive to a first current shunted from the second terminal of the current source to the substrate;

output stage means, having a first terminal with a voltage with respect to the substrate, and having second, third, and fourth terminals, for controlling the pass current in the pass transistor in response to the voltage at the first terminal of the output stage means when the collector, emitter, and base of the pass transistor are respectively coupled to the second, third, and fourth terminals of the output stage means, the first terminal of the output stage means coupled to the second terminal of the current source via the first line, the second terminal of the output stage means coupled to the input voltage terminal, and the third terminal of the output stage means coupled to the output voltage terminal;

voltage reference means, coupled to the output voltage terminal, having first, second, third, and fourth terminals, for providing at the first terminal a first reference voltage with respect to the substrate, a current limit signal at the second terminal, a bias current at the third terminal, and a start-up control signal at the fourth terminal, so that the first reference voltage, the current limit signal, the bias current, and the start-up control signal are regulated by the output voltage at the output voltage terminal;

a difference amplifier, having a first input coupled to the first terminal of the voltage reference means, and a second input with a voltage with respect to the substrate and coupled to the output voltage terminal, the difference amplifier including a matched pair of transistors coupled to the first and second inputs and having emitters coupled to the third terminal of the voltage reference means so that current flow in the emitters of the matched pair of transistors is regulated by the bias current, the difference amplifier having an output terminal with a control voltage coupled to the first terminal of the output stage means for regulating the output voltage at the output voltage terminal, wherein the control voltage is responsive to the difference between the first reference voltage and the voltage at the second input of the difference amplifier;

current shunt means, having a first terminal coupled to the fourth terminal of the voltage reference means and a second terminal coupled to the second terminal of the current source, for shunting the first current from the second terminal of the current source to the substrate in response to the start-up control signal;

first signal means, responsive to the pass current flowing in the pass transistor, for providing at a first node a first signal indicative of the pass current;

second signal means, coupled to the second terminal of the voltage reference means, for providing at a second node a second signal responsive to the current limit signal; and current limit means, coupled to the first and second nodes, for shunting a second current from the first terminal of the output stage means to the substrate in response to the first and second signals.

20. The integrated circuit as set forth in claim 19, wherein the voltage reference means comprises:

a voltage reference circuit, coupled to the output voltage terminal and the substrate, having a terminal, for providing the first reference voltage and for providing at the terminal of the voltage reference circuit a second reference voltage regulated by the output voltage;

a voltage-controlled current sink, having a terminal, coupled to the terminal of the voltage reference circuit for sinking at the terminal of the voltage-controlled current source a reference current responsive to the second reference voltage; and current mirror means coupled to the terminal of the voltage-controlled current sink and the output voltage terminal for providing the bias current, the current limit signal, and the start-up control signal, where the current limit signal is a limit current and the start-up control signal is a start-up control current, and where the bias current, the limit current, and the start-up control current are responsive to the reference current.

21. The integrated circuit as set forth in claim 19, wherein the second terminal of the current source is coupled to a second line for providing on the second line a foldback signal responsive to the source current and to the first current, wherein the second line is coupled to the second signal means so that the second signal is responsive to the foldback signal.

22. An integrated circuit with a substrate and an output voltage terminal for regulating an output voltage between the output voltage terminal and the substrate, and for starting-up and limiting pass current in a pass transistor having a base, a collector, and an emitter, the integrated circuit comprising:

an input voltage terminal having an input voltage with respect to the substrate;

a current source, having a first terminal coupled to the input voltage terminal and a second terminal coupled to a first line, for providing at the second terminal a source current responsive to the input voltage and for providing at the first line a start-up current responsive to the source current and responsive to a first current shunted from the second terminal of the current source to the substrate;

output stage means, having a first terminal with a voltage with respect to the substrate, and having second, third, and fourth terminals, for controlling the pass current in the pass transistor in response to the voltage at the first terminal of the output stage means, the collector, emitter, and base of the pass transistor respectively coupled to the second, third, and fourth terminals of the output stage means, the first terminal of the output stage means coupled to the second terminal of the current source via the first line, the second terminal of the output stage means coupled to the input voltage terminal, and the third terminal of the output stage means coupled to the output voltage terminal;

a voltage reference circuit coupled to the output voltage terminal and the substrate, having first and second terminals, for providing on the first terminal a first reference voltage and for providing on the second terminal a second reference voltage where the first and second reference voltages are regulated by the output voltage;

a voltage-controlled current sink coupled to the second terminal of the voltage reference circuit, the voltage-controlled current sink having a terminal for sinking at the terminal a reference current responsive to the second reference voltage;

a first current mirror coupled to the output voltage terminal and the terminal of the voltage-controlled current sink, the first current mirror having a bias current terminal, a start-up control current terminal, and an output terminal, for sourcing at the bias current terminal, the start-up control current terminal, and the output terminal a bias current, a start-up control current, and a second reference current, respectively, responsive to the first reference current;

a second current mirror coupled to the output terminal of the first current mirror, coupled to a second line, for sinking on the second line a limit current responsive to the second reference current;

a difference amplifier, having a first input coupled to the first terminal of the voltage reference circuit, and a second input with a voltage with respect to the substrate and coupled to the output voltage terminal, the difference amplifier including a matched pair of transistors coupled to the first and second inputs and having emitters coupled to the bias current terminal of the first current mirror so that current flow in the emitters of the matched pair of transistors is regulated by the bias current, the difference amplifier having an output terminal coupled to the first terminal of the output stage means for regulating the output voltage at the output voltage terminal;

current shunt means, having a first terminal coupled to the start-up control current terminal of the first current mirror and a second terminal coupled to the second terminal of the current source, for shunting the first current responsive to the start-up control current;

first signal means, responsive to the pass current flowing in the pass transistor, for providing at a first node a first signal indicative of the pass current;

second signal means, coupled to the second line, for providing at a second node a second signal responsive to the limit current; and current limit means, coupled to the first and second nodes, for shunting a second current from the first terminal of the output stage means to the substrate in response to the first and second signals.

23. The integrated circuit as set forth in claim 22, wherein the first signal means comprises:

a first transistor having a base coupled to the fourth terminal of the output stage means, an emitter coupled to the output voltage terminal, and a collector coupled to the first node; and a first resistor coupled between the input voltage terminal and the first node, so that the first signal is a first voltage with respect to the substrate;

the second signal means comprises a second resistor coupled between the input voltage terminal and the second node, wherein the second node is coupled to the second line, so that the second signal is a second voltage with respect to the substrate and is responsive to the limit current; and the current limit means comprises:

an amplifier with a first input coupled to the first node, a second input coupled to the second node, an output with a voltage responsive to the difference between the first and second voltages; and a second transistor having a base coupled to the output of the amplifier, an emitter coupled to the substrate, and a collector coupled to the first input of the output stage means for shunting the second current.

24. The integrated circuit as set forth in claim 22, further comprising:

a third current mirror coupled to the second terminal of the current source and coupled to a third line, having an output terminal, for sinking a third current on the output terminal and for sinking a foldback current on the third line where the third current and the foldback current are responsive to the source current and the first current; wherein the third line is coupled to the second signal means so that the second signal is responsive to the foldback current; and a fourth current mirror coupled to the input voltage terminal, the output terminal of the third current mirror, and the first line, for providing the start-up current where the start-up current is responsive to the third current.

* * * * *